US005716465A

United States Patent [19]

Hara et al.

[11] Patent Number: 5,716,465

[45] Date of Patent: Feb. 10, 1998

[54] HIGH-CORROSION-RESISTANT MARTENSITIC STAINLESS STEEL HAVING EXCELLENT WELDABILITY AND PROCESS FOR PRODUCING THE SAME

[75] Inventors: Takuya Hara; Asahi Hitoshi; Hiroshi Tamehiro; Taro Muraki, all of Chiba-Ken; Akira Kawakami, Tokyo-To, all of Japan

[73] Assignee: Nippon Steel Corporation, Tokyo, Japan

[21] Appl. No.: 649,701

[22] PCT Filed: Sep. 27, 1995

[86] PCT No.: PCT/JP95/01950

§ 371 Date: Aug. 27, 1996

§ 102(e) Date: Aug. 27, 1996

[87] PCT Pub. No.: WO96/10654

PCT Pub. Date: Apr. 11, 1996

[30] Foreign Application Priority Data

| | | | |
|---|---|---|---|
| Sep. 30, 1994 | [JP] | Japan | 6-237918 |
| Sep. 30, 1994 | [JP] | Japan | 6-237919 |
| Sep. 30, 1994 | [JP] | Japan | 6-237920 |

[51] Int. Cl.[6] ..... C22C 38/42; C21D 8/02

[52] U.S. Cl. ..... 148/325; 148/608; 148/610

[58] Field of Search ..... 148/608, 610, 148/325; 420/60, 61

[56] References Cited

U.S. PATENT DOCUMENTS

| | | | |
|---|---|---|---|
| 5,089,067 | 2/1992 | Schumacher | 148/325 |

FOREIGN PATENT DOCUMENTS

| | | | |
|---|---|---|---|
| 273279 | 6/1988 | European Pat. Off. | 148/610 |
| 4-268019 | 9/1992 | Japan . | |
| 5-156408 | 6/1993 | Japan . | |
| 5-163529 | 6/1993 | Japan . | |
| 1214293 | 12/1970 | United Kingdom | 148/325 |

*Primary Examiner*—Deborah Yee

*Attorney, Agent, or Firm*—Kenyon & Kenyon

[57] ABSTRACT

A high-corrosion-resistant martensitic stainless steel possessing excellent weldability and SSC resistance, having a tempered martensitic structure, characterized by comprising steel constituents satisfying by weight C: 0.005 to 0.035%, Si: not more than 0.50%, Mn: 0.1 to 1.0%, P: not more than 0.03%, S: not more than 0.005%, Mo: 1.0 to 3.0%, Cu: 1.0 to 4.0%, Ni: 1.5 to 5.0%, Al: not more than 0.06%, N: not more than 0.01%, and Cr satisfying a requirement represented by the formula $13>Cr+1.6Mo\geqq 8$, $$C+N\geqq 0.03,$$

$$40C+34N+Ni+0.3Cu-1.1Cr-1.8\,Mo\geqq 10,$$

or further comprising at least one element selected from the group consisting of Ti: 0.05 to 0.1%, Zr: 0.01 to 0.2%, Ca: 0.001 to 0.02%, and REM: 0.003 to 0.4%, with the balance consisting essentially of Fe. A process for producing a martensitic stainless steel, comprising the steps of: subjecting a steel plate, produced by hot-rolling a stainless steel slab having the above composition, to austenitization at a temperature of $Ac_3$ point to 1000° C. to harden the steel plate; subjecting the hardened steel plate to final tempering at a temperature of 550° C. to $Ac_1$ point; and cold-rolling the steel plate.

16 Claims, 3 Drawing Sheets

HIGH-CORROSION-RESISTANT MARTENSITIC STAINLESS STEEL HAVING EXCELLENT WELDABILITY AND PROCESS FOR PRODUCING THE SAME

TECHNICAL FIELD

The present invention relates to a martensitic stainless steel having excellent resistance to corrosion by $CO_2$ and sulfide stress cracking and good weldability.

BACKGROUND ART

In recent years, the development of gas wells for producing petroleum and natural gas containing a large amount of carbon dioxide gas ($CO_2$) and $CO_2$ injection, where $CO_2$ is introduced into an oil well or a gas well to recover petroleum, have become extensively used in the art. Due to severe corrosion, 13% Cr martensitic stainless steels exemplified by AISI420 steel having excellent resistance to corrosion by $CO_2$ have been used as an oil well pipe in such environments. Since line pipes emerged on the ground surface are joined to each other by welding, materials having excellent weldability are required of the line pipes. Since, however, these steels have a high C content, joining thereof by welding creates a weld which is very hard and has poor impact toughness. For this reason, line pipes of a higher-grade, duplex stainless steel have been reluctantly used. Further, since these line pipes are used in cold districts, the impact toughness of heat-affected zone is often specified to −20° C. or below in terms of the ductile-brittle transition temperature.

In order to improve the weldability, it is generally necessary to lower the C content. Martensitic materials wherein the C content has been lowered to improve the weldability are disclosed, for example, in Japanese Patent Laid-Open Nos. 99127/1992 and 99128/1992. These steels, however, are still unsatisfactory in weldability and hot workability, making it difficult to actually produce such steels, or further have unsatisfactory sulfide stress cracking resistance (SSC resistance). Therefore, the quality of the steels is not yet on a level high enough to be usable as an alternative for the duplex stainless steel.

An object of the present invention is to provide a martensitic stainless steel having $CO_2$ corrosion resistance high enough to withstand the maximum service temperature of the line pipe, excellent sulfide stress cracking resistance (SSC resistance), and good toughness of welding heat-affected zone by regulating specific constituents.

DISCLOSURE OF INVENTION

The high-corrosion-resistant martensitic stainless steel having excellent weldability of the present invention is characterized by comprising steel constituents satisfying by weight C: 0.005 to 0.035%, Si: not more than 0.50%, Mn: 0.1 to 1.0%, P: not more than 0.03%, S: not more than 0.005%, Cr: 10.0 to 13.5%, Cu: 1.0 to 4.0%, Ni: 1.5 to 5.0%, Al: not more than 0.06%, and N: not more than 0.01%, $$C+N \leqq 0.03,$$

$$40C+34N+Ni+0.3Cu-1.1Cr \geqq -10,$$

or further comprising at least one element selected from the group consisting of Ti: 0.005 to 0.1%, Zr: 0.01 to 0.2%, Ca: 0.001 to 0.02%, and REM: 0.003 to 0.4%, with the balance consisting essentially of Fe.

Further, the martensitic stainless steel having excellent weldability and SSC resistance according to the present invention is characterized by comprising steel constituents satisfying by weight C: 0.005 to 0.035%, Si: not more than 0.50%, Mn: 0.1 to 1.0%, P: not more than 0.03%, S: not more than 0.005%, Mo: 1.0 to 3.0%, Cu: 1.0 to 4.0%, Ni: 1.5 to 5.0%, Al: not more than 0.06%, N: not more than 0.01%, and Cr satisfying a requirement represented by the formula $13>Cr+1.6Mo \geqq 8$, $$C+N \leqq 0.03,$$

$$40C+34N+Ni+0.3Cu-1.1Cr-1.8\,Mo \geqq -10,$$

or further comprising at least one element selected from the group consisting of Ti: 0.05 to 0.1%, Zr: 0.01 to 0.2%, Ca: 0.001 to 0.02%, and REM: 0.003 to 0.4%, with the balance consisting essentially of Fe.

The process for producing a high-corrosion-resistant martensitic stainless steel according to the present invention is characterized by comprising the steps of: subjecting a steel plate, produced by hot-rolling a stainless steel slab having the above composition, to austenitization at a temperature of $Ac_3$ point to 1000° C.; subjecting the hardened steel plate to final tempering at a temperature of 550° C. to $Ac_1$ point; and cold-rolling the steel plate to prepare a steel pipe.

BEST MODE FOR CARRYING OUT INVENTION

From the results of many experiments conducted on the behavior of various elements on the corrosion resistance, mechanical properties and other properties, the present inventors have found that (1) the resistance to corrosion by $CO_2$ can be improved by the addition of Cu and Ni in combination, (2) the sulfide stress cracking resistance can be improved by adding Mo, and (3) the toughness of the weld heat-affected zone can be improved by lowering the C and N contents and regulating the constituents of the steel so as to provide a martensite phase.

The present invention will now be described in more detail.

Figure 1:
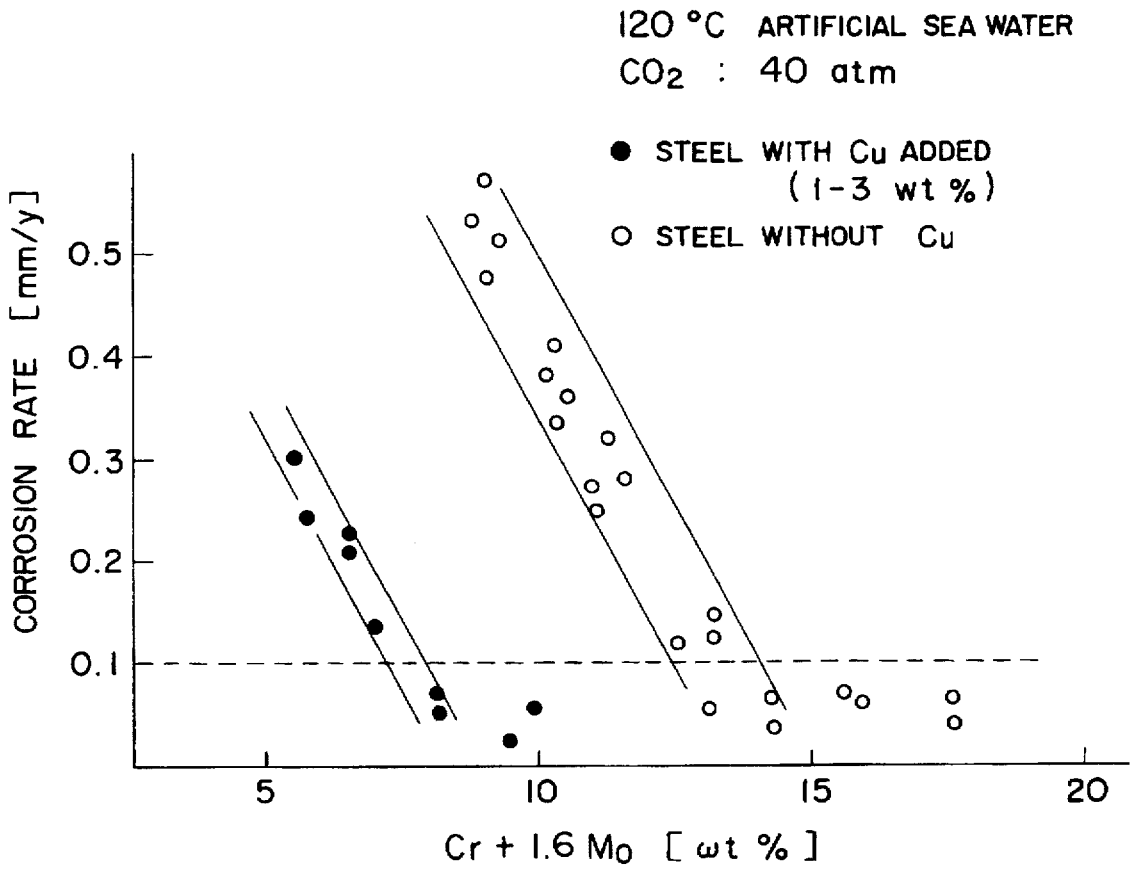
FIG. 1 is a diagram showing the influence of alloying elements on the resistance to corrosion by $CO_2$, particularly the relationship between the Cr and Mo contents in terms of (Cr+1.6Mo) of steels with Cu added or not added thereto and the corrosion rate.

At the outset, the present inventors have investigated the influence of various elements on the resistance of the steel to corrosion by $CO_2$. FIG. 1 is a diagram showing the corrosion rate of 0.02%C-2%Ni steels with varied Cr, Mo, and Cu contents.

In FIG. 1, ● represents data for steels having a Cu content of 1 to 3%, and ○ represents data for steels with no Cu added thereto. The corrosion rate is expressed as the depth of corrosion per year in substitute ocean water of 120° C. saturated with $CO_2$ gas of 40 atm. When the corrosion rate is not more than 0.1 mm/y, the steel is evaluated as having satisfactory corrosion resistance. As can be seen from FIG. 1, the contribution of Mo to the corrosion rate is 1.6 times greater than the contribution of Cr to the corrosion rate. The corrosion rate of the steel with Cu added is the same as that of the steel wherein the content of Cr+1.6Mo is 5% higher than the steel with Cu not added.

It is noted that Cr and Mo are typical ferrite forming elements and the incorporation of these elements in a large amount results in the formation of a ferrite phase. In order to bring the corrosion rate to not more than 0.1 mm/y, the content of Cr+1.6Mo=7.5 to 8.0% is necessary for the steel with Cu added thereto, while, in the case of the steel with Cu not added thereto, the content of Cr+1.6Mo=12.5 to 14.5% is necessary. In order to form a martensitic structure using the Cr and Mo contents on the above level, the addition of a large amount of an austenite forming element is necessary, rendering the conditions, necessary for lowering the C and N contents, more strict.

On the other hand, in the case of a steel containing not less than 1% of Cu with Cr+1.6Mo=7.5 to 8.0%, the addition of an austenite forming element even in a small amount can bring the structure to a singe phase of martensite, and Cu per se is an austenite forming element, which is advantageous also from the viewpoint of phase stability. Thus, for the steel with Cu added thereto, elements can be selected under very advantageous conditions.

Next, the present inventors have investigated environmental conditions under which sulfide stress cracking (SSC) is created. The relationship between the partial pressure of $H_2S$ and pH was investigated, and the results are given in FIG. 2.

Figure 2:
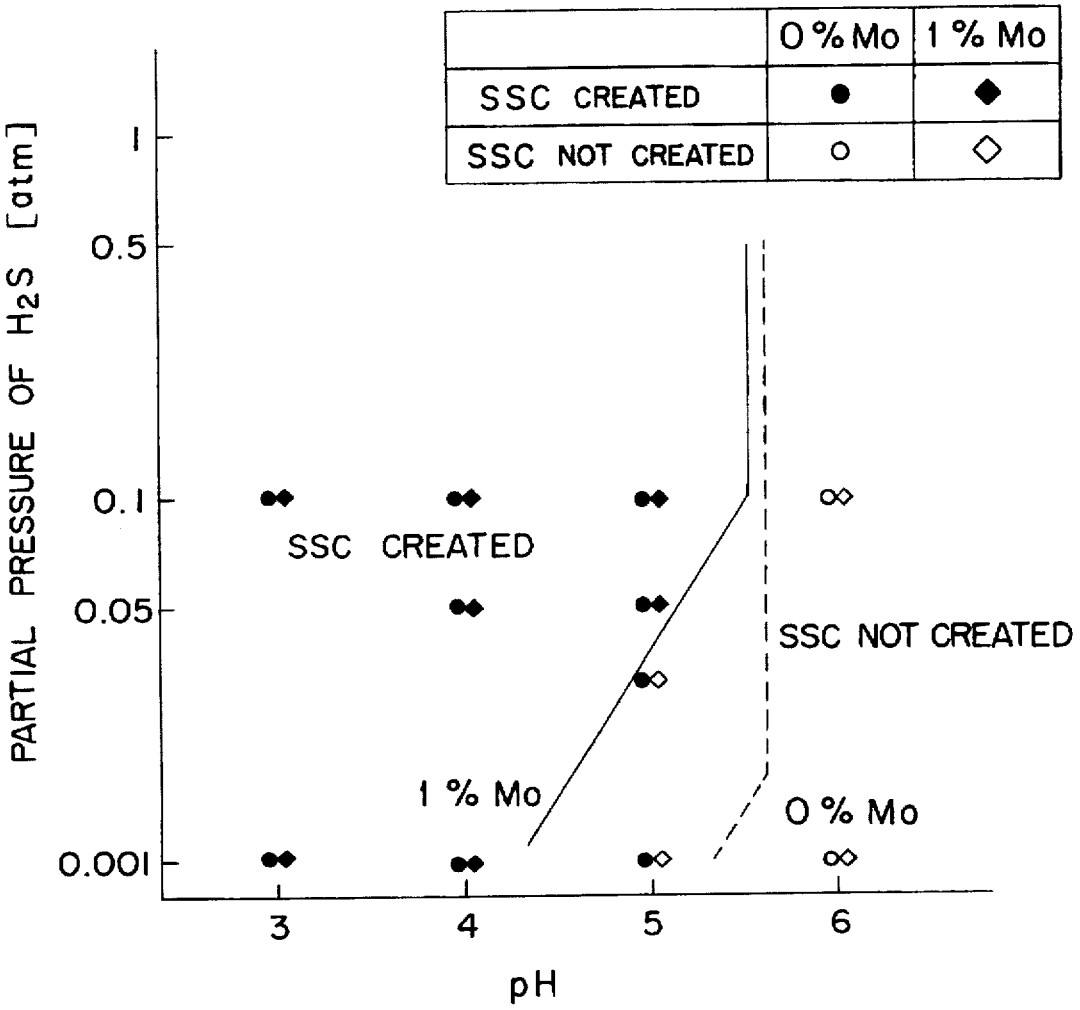
FIG. 2 is a diagram showing the influence of Mo on the sulfide stress cracking resistance.

In FIG. 2, both ○ and ● represent steels with Mo: 0%, and both ◇ and ♦ represent steels with Mo: 1%. For the steels represented by ○ and ◇, SSC was not occurred, whereas for the steels represented by ● and ♦, SSC was occurred. A dotted line represents the boundary between the occurrence of SSC and the freedom from SSC with respect to 0% Mo, and a solid line represents the boundary between the occurrence of SSC and the freedom from SSC with respect to 1% Mo. From FIG. 2, it is apparent that steels with Mo added are free from SSC even under severe conditions of high partial pressure of $H_2S$ and low pH.

Figure 3:
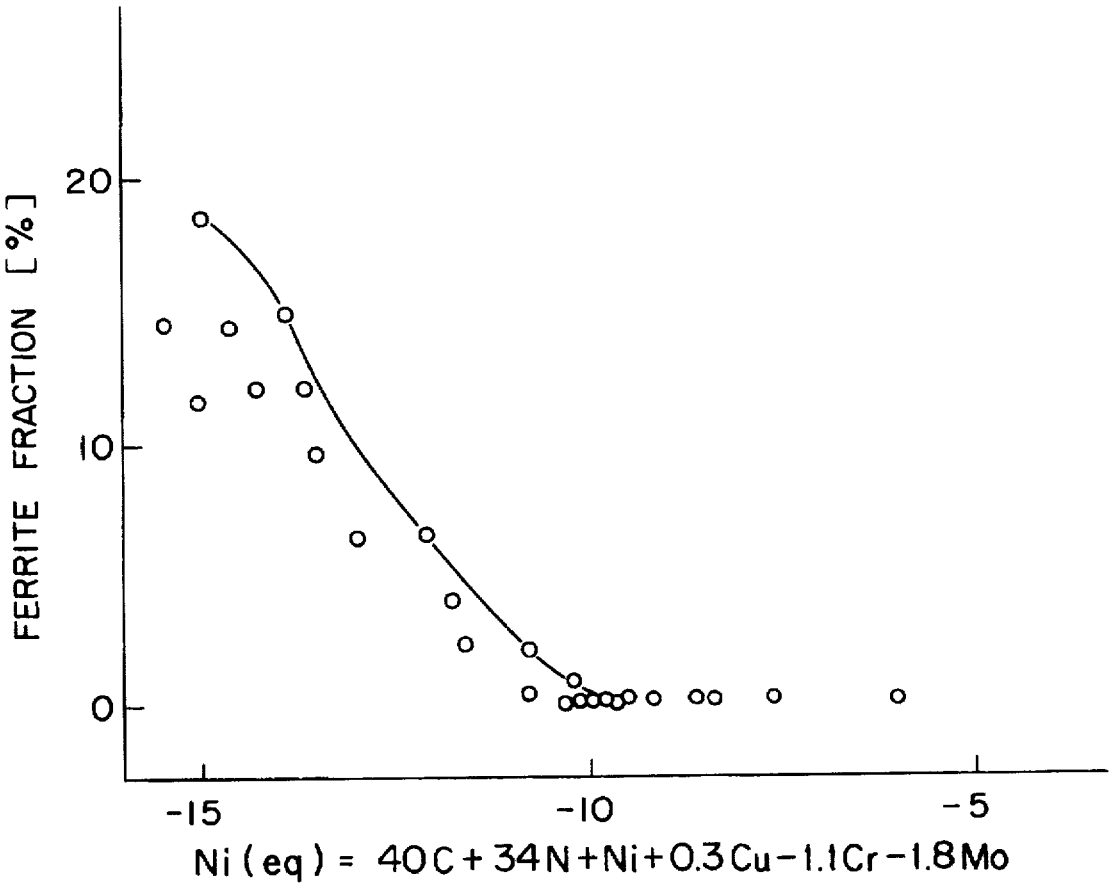
FIG. 3 is a diagram showing the influence of the Ni equivalent on the ferrite phase fraction at the time of heating at a high temperature.

It has been found that the toughness of the weld heat-affected zone can be improved when the structure consists of a single phase of martensite free from δ-ferrite phase and, at the same time, has lowered C and N contents. FIG. 3 is a diagram showing the contribution of each element to the ferrite fraction at the time of heating of the steel at a high temperature. From FIG. 3, it is apparent that when Ni(eq) =40C+34N+Ni+0.3Cu−1.1Cr−1.8Mo is greater than −10, the formation of the ferrite phase is inhibited resulting in the formation of a single phase of martensite.

The content range of each alloying constituent specified in the present invention will be described.

C: C is an element which forms a Cr carbide or the like and deteriorates the corrosion resistance. It, however, has a high capability of forming austenite, offering the effect of inhibiting the formation of a ferrite phase. When the amount of C added is less than 0.005%, the contemplated effect cannot be attained. On the other hand, the addition of C in an amount exceeding 0.035% causes precipitation of a large amount of carbides, such as Cr carbide, resulting in deteriorated toughness and, at the same time, enhances the hardness of the weld heat-affected zone, here again resulting in deteriorated toughness. For the above reason, the C content is limited to 0.005 to 0.035%.

Si: Si contained in the steel is the residual Si after use as a deoxidizer in steelmaking. When the Si content exceeds 0.50%, the toughness and the sulfide stress cracking resistance are deteriorated. Therefore, the Si content is limited to not more than 0.50%.

Mn: Mn is an element which lowers the intergranular strength and deteriorates the cracking resistance in a corrosive environment. It, however, serves to form MnS, rendering S harmless. In addition, it is useful for bringing the structure to a single phase of austenite. When the Mn content is less than 0.1%, the contemplated effect cannot be attained. On the other hand, when it exceeds 1.0%, the intergranular strength is significantly lowered. For this reason, the Mn content is limited to 0.1 to 1.0%.

P: P segregates in the grain boundaries and consequently lowers the intergranular strength, resulting in deteriorated sulfide stress cracking resistance. Therefore, the P content is limited to not more than 0.03%.

S: S forms inclusions based on sulfides, deteriorating the hot workability. Therefore, the upper limit of the S content is 0.005%.

Mo: As with Cr, Mo serves to improve the $CO_2$ corrosion resistance and, in addition, as shown in FIG. 2, has the effect of improving the SSC resistance. When the Mo content is less than 1.0%, the contemplated effect is unsatisfactory. Therefore, the amount of Mo added is limited to not less than 1.0%- On the other hand, when the amount of Mo added is excessively large, the effect is saturated and, at the same time, the deformation resistance on heating is increased, resulting in lowered hot workability. For this reason, the upper limit of the Mo content is 3.0%.

Cu: Cu is the most important additive element which is enriched in a corrosion film to improve the resistance to corrosion by $CO_2$ as shown in FIG. 1. A combination of desired corrosion resistance with martensitic structure cannot be attained without Cu. When the Cu content is less than 1.0%, the effect is unsatisfactory. Therefore, the Cu content is limited to not less than 1.0%. On the other hand, when it is excessively high, the hot workability is deteriorated. For this reason, the upper limit of the Cu content is 4.0%.

Ni: The ability of Cu to improve the corrosion resistance can be markedly improved by adding Cu in combination with Ni. This is considered attributable to the fact that Cu combines with Ni to form a compound which is enriched in the corrosion film. The Cu enrichment is difficult in the absence of Ni. Further, Ni is an element having a high capability of forming austenite and, hence, is useful for realizing the martensitic structure and improving the hot workability. When the Ni content is less than 1.5%, the effect of improving the hot workability is unsatisfactory, while when it exceeds 5%, the $Ac_1$ transformation point becomes excessively low, rendering the tempering difficult. For the above reason, the Ni content is limited to 1.5 to 5%.

Al: As in the case of Si, Al contained in the steel is the residual Al after use as a deoxidizer in steelmaking. When the Al content exceeds 0.06%, AlN is formed in a large amount, resulting in deteriorated toughness of the steel. For this reason, the upper limit of the Al content is 0.06%.

N: N is an element which is unavoidably contained in the steel. It enhances the hardness of the weld heat-affected zone and deteriorates the toughness. For this reason, the upper limit of the N content is 0.01%.

C+N: C and N act similarly to each other and deteriorate the toughness of the weld heat-affected zone. The addition of C and N in a total amount exceeding 0.03% results in deteriorated toughness. For this reason, the total content of C and N is limited to not more than 0.03%.

Cr+1. 6Mo: Cr serves to improve the resistance to corrosion by $CO_2$. Mo functions likewise. Experiments have revealed that, as shown in FIG. 1, the contribution of Mo to the corrosion rate is 1/1.6 time the contribution of Cr to the corrosion rate. Therefore, the Cr content is not limited alone but as Cr+1.6Mo. Based on the results shown in FIG. 1, the lower limit of the content of Cr+1.6Mo is not less than 8. An excessively high content of Cr+1.6Mo increases the contents of C, N, and Ni required and, at the same time, provides excessively high material strength. For this reason, the upper limit of the content of Cr+1.6Mo is 13.

The steel of the present invention having the above composition has good resistance to corrosion by $CO_2$. However, when ferrite forming elements, such as Cr and Mo, are present in a large amount, a ferrite phase is formed in weld heat-affected zone resulting in deteriorated toughness. Therefore, the contents of ferrite forming elements should be limited. It is known that C, N, Ni, and Cu inhibit the formation of the ferrite phase, whereas Cr and Mo accelerate the formation of the ferrite phase. Steels with varied content of these elements were prepared by the melt process to experimentally determine the contribution of individual elements. As a result, it has been found that, when $Ni(eq)=40C+34N+Ni+0.3Cu-1.1Cr-1.8Mo \geqq -10$ is satisfied, no ferrite phase is formed and the structure is constituted by a single phase of martensite. For this, C, N, Ni, Cu, Cr, and Mo should satisfy the above requirement.

Ti: Ti is dispersed as TiN or Ti oxides to inhibit the grain growth in weld heat-affected zone to inhibit the deterioration of the toughness. When the Ti content is excessively low, the contemplated effect cannot be attained. On the other hand, when it is excessively high, TiC is precipitated resulting in deteriorated toughness. For this reason, the Ti content is limited to 0.005 to 0.1%. In this case, N which has been fixed as TiN does not contribute to the hardness of the weld heat-affected zone and, hence, does not contribute to the deterioration of the toughness. For this reason, the total content of N in the form of TiN, that is, (N−3.4Ti), and C may be not more than 0.03.

Ca and REM: Ca and REM serve to bring inclusions to a spherical form, thus rendering the inclusions harmless. When the content of Ca and REM is excessively low, the contemplated effect cannot be attained, while when it is excessively high, the amount of inclusions becomes so large that the sulfide stress cracking resistance is deteriorated. Therefore, the Ca content is limited to 0.001 to 0.02%, and the REM content is limited to 0.003 to 0.4%.

Zr: Zr combines with P detrimental to the sulfide stress cracking resistance to form a stable compound, thereby reducing the amount of P in a solid solution form to substantially reduce the P content. When the Zr content is excessively low, the contemplated effect cannot be attained. On the other hand, when it is excessively high, coarse oxides are formed to lower the toughness and the sulfide stress cracking resistance. For this reason, the Zr content is limited to 0.01 to 0.2%.

The above steel as hot-rolled and after reheating to the $Ac_3$ transformation point or above has a martensitic structure. Since, however, the steel having a martensitic structure is too hard and has low sulfide stress cracking resistance, it should be tempered to form a tempered martensitic structure. When the strength cannot be reduced to a desired level by certain tempering, the formation of martensite followed by heating to a dual-phase region between $Ac_1$ and $Ac_3$ and additional tempering can provide a tempered martensitic structure having low strength.

Conditions for the production of the steel of the present invention will be described.

The steel of the present invention is quenched at a temperature of $Ac_3$ to 1000° C. This is because when the hardening temperature exceeds 1000° C., grains are coarsened to deteriorate the toughness, while when it is below $Ac_3$, a dual-phase region of austenite and ferrite is formed.

Further, it is difficult to easily temper the steel of the present invention by conducting tempering once. For this reason, the tempering is usually carried out twice. However, when single tempering suffices for the contemplated purpose, there is no need to repeat the tempering procedure. Regarding the final tempering temperature, when the temperature exceeds $Ac_1$, fresh martensite is formed after tempering, resulting in increased hardness and deteriorated toughness. Therefore, the upper limit of the final tempering temperature is $Ac_1$. On the other hand, a tempering temperature below 550° C. is excessively low for attaining contemplated tempering. Therefore, in this case, the tempering is unsatisfactory, and, in addition, the hardness is not decreased. For the above reason, the lower limit of the final tempering temperature is 550° C.

The present invention will now be described in more detail with reference to the following examples.

At the outset, steels having chemical compositions specified in Table 1 were prepared by the melt process, cast, and rolled by a model rolling mill into seamless steel pipes which were then heat-treated under conditions specified in Table 2. Steel Nos. 1 to 8 are steels of the present invention, and steel Nos. 9 to 13 are comparative steels. N and C+(N−3.4Ti) for steel No. 9, Cr+1.6Mo and Ni(eq) for steel No. 10, Cu for steel No. 11, Ni for steel No. 12, and Mo for steel No. 13 are outside the scope of the present invention.

The resistance to corrosion by $CO_2$ was determined by immersing a test piece in substitute ocean water of 120° C. saturated with $CO_2$ gas of 40 atm and measuring the weight loss by corrosion to determine the corrosion rate.

The sulfide stress cracking resistance was determined by mixing 1N acetic acid with 1 mol/liter sodium acetate to adjust the solution to pH 3.5, saturating the solution with 10% hydrogen sulfide+90% nitrogen gas or carbon dioxide gas, placing an unnotched round rod test piece (diameter in parallel portion 6.4 mm, length in parallel portion 25 mm) into the solution, applying in this state a tensile stress corresponding to 80% of the yield strength to the test piece to measure the time taken for the test piece to be broken (breaking time). When the test piece is not broken in a 720-hr test, it can be regarded as having excellent sulfide stress cracking resistance.

Further, a test on a simulated heat affected zone corresponding to a heat input of 2 kJ/mm was conducted to measure the transition temperature (vTrs) for a JIS No. 4 test piece for a Charpy impact test. The test results are also summarized in Table 2.

As is apparent from the results given in Table 2, steel Nos. 9, 10, and 12 had respective vTrs values of 5° C., 12° C., and −17° C., i.e., had deteriorated toughness in heat-affected zone, indicating that these steels do not satisfy the requirement for the impact toughness of the heat-affected zone (vTrs<−20° C.). For steel Nos. 11 and 12, the corrosion rate is significantly high, and steel No. 13 occurred sulfide stress cracking.

TABLE 1

| Steel No. | Chemical composition (wt %) | | | | | | | | | | | |
|---|---|---|---|---|---|---|---|---|---|---|---|---|
| | C | Si | Mn | P | S | Cr | Mo | Cu | Ni | Al | N | Others |
| Steel of inv. | | | | | | | | | | | | |
| 1 | 0.020 | 0.03 | 0.3 | 0.010 | 0.001 | 8.6 | 1.5 | 1.8 | 2.1 | 0.030 | 0.012 | Ti: 0.007 |
| 2 | 0.015 | 0.12 | 0.7 | 0.005 | 0.003 | 10.5 | 1.4 | 1.5 | 4.3 | 0.018 | 0.003 | — |
| 3 | 0.012 | 0.31 | 0.4 | 0.017 | 0.002 | 6.9 | 1.2 | 2.1 | 1.8 | 0.014 | 0.003 | Zr: 0.06 |
| 4 | 0.009 | 0.18 | 0.5 | 0.014 | 0.003 | 7.2 | 2.4 | 2.8 | 3.7 | 0.020 | 0.004 | Ti: 0.030<br>Ca: 0.008 |
| 5 | 0.022 | 0.08 | 0.6 | 0.022 | 0.002 | 8.0 | 1.8 | 3.4 | 1.7 | 0.022 | 0.003 | — |
| 6 | 0.021 | 0.15 | 0.6 | 0.012 | 0.002 | 11.3 | 1.0 | 1.7 | 3.0 | 0.013 | 0.005 | — |
| 7 | 0.013 | 0.17 | 0.9 | 0.003 | 0.001 | 11.0 | 1.1 | 3.2 | 3.0 | 0.018 | 0.008 | REM: 0.019 |
| 8 | 0.010 | 0.09 | 0.7 | 0.009 | 0.002 | 9.1 | 1.8 | 1.8 | 3.5 | 0.024 | 0.005 | — |
| Comparative steel | | | | | | | | | | | | |
| 9 | 0.018 | 0.05 | 0.5 | 0.012 | 0.003 | 8.9 | 1.5 | 1.7 | 2.2 | 0.031 | 0.034 | — |
| 10 | 0.012 | 0.13 | 0.4 | 0.007 | 0.003 | 12.0 | 2.1 | 2.0 | 3.0 | 0.035 | 0.005 | — |
| 11 | 0.021 | 0.18 | 0.6 | 0.013 | 0.002 | 8.9 | 1.6 | — | 4.2 | 0.025 | 0.005 | — |
| 12 | 0.020 | 0.25 | 0.5 | 0.015 | 0.001 | 8.4 | 1.2 | 2.8 | 0.5 | 0.045 | 0.007 | — |
| 13 | 0.016 | 0.14 | 0.7 | 0.011 | 0.002 | 12.1 | — | 2.4 | 3.4 | 0.032 | 0.007 | — |

| Steel No. | C + (N − 3.4Ti) | Cr + 1.6Mo | *Ni (eq) |
|---|---|---|---|
| Steel of inv | | | |
| 1 | 0.020 | 11.0 | −8.55 |
| 2 | 0.018 | 12.7 | −8.62 |
| 3 | 0.015 | 8.8 | −6.74 |
| 4 | 0.009 | 11.0 | −7.20 |
| 5 | 0.025 | 10.9 | −8.34 |
| 6 | 0.026 | 12.9 | −9.71 |
| 7 | 0.021 | 12.8 | −9.33 |
| 8 | 0.015 | 12.0 | −8.64 |
| Comparative steel | | | |
| 9 | 0.052 | 11.3 | −7.90 |
| 10 | 0.017 | 15.4 | −12.73 |
| 11 | 0.026 | 11.5 | −7.46 |
| 12 | 0.027 | 10.3 | −9.0 |
| 13 | 0.023 | 12.1 | −8.31 |

*Ni (eq) = 40C + 34N + Ni + 0.3Cu − 1.1Cr − 1.8Mo

TABLE 2

| Steel No. | Reheating conditions | Tempering (1) | Tempering (2) | YS [MPa] | TS [MPa] | Corrosion rate [mm/y] | Toughness of heat-affected zone vTrs [°C.] | Sulfide stress cracking |
|---|---|---|---|---|---|---|---|---|
| Steel of inv. | | | | | | | | |
| 1 | — | 580° C. × 30 min | — | 683 | 804 | 0.04 | −21 | NF |
| 1 | 890° C. × 30 min air cooling | 580° C. × 30 min | — | 675 | 796 | 0.05 | −24 | NF |
| 1 | 890° C. × 30 min air cooling | 660° C. × 30 min | 580° C. × 30 min | 621 | 729 | 0.04 | −23 | NF |
| 2 | — | 580° C. × 30 min | — | 701 | 824 | 0.02 | −25 | NF |
| 2 | 890° C. × 30 min air cooling | 580° C. × 30 min | — | 692 | 812 | 0.03 | −25 | NF |
| 2 | 890° C. × 30 min air cooling | 660° C. × 30 min | 580° C. × 30 min | 667 | 787 | 0.02 | −28 | NF |
| 3 | 890° C. × 30 min air cooling | 580° C. × 30 min | — | 636 | 757 | 0.08 | −27 | NF |
| 4 | 890° C. × 30 min air cooling | 580° C. × 30 min | — | 628 | 747 | 0.08 | −37 | NF |
| 5 | 890° C. × 30 min air cooling | 580° C. × 30 min | — | 688 | 810 | 0.07 | −26 | NF |
| 6 | 890° C. × 30 min air cooling | 660° C. × 30 min | 580° C. × 30 min | 630 | 750 | 0.02 | −25 | NF |
| 7 | 890° C. × 30 min air cooling | 580° C. × 30 min | — | 689 | 801 | 0.02 | −30 | NF |
| 8 | 890° C. × 30 min air cooling | 580° C. × 30 min | — | 673 | 792 | 0.03 | −41 | NF |

TABLE 2-continued

| Steel No. | Reheating conditions | Tempering (1) | Tempering (2) | YS [MPa] | TS [MPa] | Corrosion rate [mm/y] | Toughness of heat-affected zone vTrs [°C.] | Sulfide stress cracking |
|---|---|---|---|---|---|---|---|---|
| Comparative steel | | | | | | | | |
| 9 | 890° C. × 30 min air cooling | 580° C. × 30 min | — | 696 | 826 | 0.09 | 5 | NF |
| 10 | 890° C. × 30 min air cooling | 580° C. × 30 min | — | 678 | 798 | 0.02 | 12 | NF |
| 11 | 890° C. × 30 min air cooling | 580° C. × 30 min | — | 664 | 781 | 0.43 | −25 | NF |
| 12 | 890° C. × 30 min air cooling | 580° C. × 30 min | — | 655 | 771 | 0.57 | −17 | NF |
| 13 | 890° C. × 30 min air cooling | 580° C. × 30 min | — | 631 | 742 | 0.04 | −29 | F |

NF: Not failed
F: Failed

We claim:

1. A high-corrosion-resistant martensitic stainless steel possessing excellent weldability, having a tempered martensitic structure, characterized by comprising steel constituents satisfying by weight C: 0.005 to 0.035%, Si: not more than 0.50%, Mn: 0.1 to 1.0%, P: not more than 0.03% S: not more than 0.005% Cr: 10.0 to 13 5% Cu: 10 to 4.0%, Ni: 1.5 to 5.0%, Al: not more than 0.06%, and N: not more than 0.01%, $$C+N \leqq 0.03,$$

$$40C+34N+Ni+0.3Cu-1.1Cr \geqq -10,$$

with the balance consisting essentially of Fe.

2. A high-corrosion-resistant martensitic stainless steel possessing excellent weldability, having a tempered martensitic structure, characterized by comprising steel constituents satisfying by weight C: 0.005 to 0.035%, Si: not more than 0.50%, Mn: 0.1 to 1.0%, P: not more than 0.03%, S: not more than 0.005%, Cr: 10.0 to 13.5%, Cu: 1.0 to 4.0%, Ni: 1.5 to 5.0%, Al: not more than 0.06%, Ti: 0.005 to 0.1%, and N: not more than 0.01%, $$C+(N-3.4Ti) \leqq 0.03,$$

$$40C+34N+Ni+0.3Cu-1.1Cr \geqq -10,$$

with the balance consisting essentially of Fe.

3. A high-corrosion-resistant martensitic stainless steel possessing excellent weldability and SSC resistance, having a tempered martensitic structure, characterized by comprising steel constituents satisfying by weight C: 0.005 to 0.035%, Si: not more than 0.50%, Mn: 0.1 to 1.0%, P: not more than 0.03%, S: not more than 0.005%, Mo: 1.0 to 3.0%, Cu: 1.0 to 4.0%, Ni: 1.5 to 5.0%, Al: not more than 0.06%, N: not more than 0.01%, and Cr satisfying a requirement represented by the formula 13>Cr+1.6Mo≧8, $$C+N \leqq 0.03,$$

$$40C+34N+Ni+0.3Cu-1.1Cr-1.8\,Mo \geqq -10,$$

with the balance consisting essentially of Fe.

4. A high-corrosion-resistant martensitic stainless steel possessing excellent weldability and SSC resistance, having a tempered martensitic structure, characterized by comprising steel constituents satisfying by weight C: 0.005 to 0.035%, Si: not more than 0.50%, Mn: 0.1 to 1.0%, P: not more than 0.03%, S: not more than 0.005%, Mo: 1.0 to 3.0%, Cu: 1.0 to 4.0%, Ni: 1.5 to 5.0%, Al: not more than 0.06%, Ti: 0.05 to 0.1%, N: not more than 0.01%, and Cr satisfying a requirement represented by the formula 13>Cr+1.6Mo≧8, $$C+(N-3.4Ti) \leqq 0.03,$$

$$40C+34N+Ni+0.3Cu-1.1Cr-1.8\,Mo \geqq -10,$$

with the balance consisting essentially of Fe, provided that (N−3.4Ti) gives a value of N−3.4Ti when N−3.4Ti≧0, and 0 (zero) when N−3.4Ti<0.

5. A high-corrosion-resistant martensitic stainless steel possessing excellent weldability, characterized by comprising steel constituents constituting a steel according to claim 1 and further comprising Zr: 0.01 to 0.2%.

6. A high-corrosion-resistant martensitic stainless steel possessing excellent weldability, characterized by comprising steel constituents constituting a steel according to claim 1 and further comprising at least one element selected from the group consisting of Ca: 0.001 to 0.02% and 0.003 to 0.4% of REM.

7. A process for producing a high-corrosion-resistant martensitic stainless steel possessing excellent weldability, characterized by comprising the steps of: subjecting a steel plate, produced by hot-rolling a stainless steel slab having a composition according to claim 1 to austenitization at a temperature of $Ac_3$ point to 1000° C. to harden the steel plate and heating to a dual phase region between $Ac_a$ point and $Ac_3$ point; subjecting the hardened steel plate to final tempering at a temperature of 550° C. to $Ac_1$ point; and cold-rolling the steel plate.

8. A high-corrosion-resistant martensitic stainless steel possessing excellent weldability, characterized by comprising steel constituents constituting a steel according to claim 2 and further comprising Zr: 0.01 to 0.2%.

9. A high-corrosion-resistant martensitic stainless steel possessing excellent weldability, characterized by comprising steel constituents constituting a steel according to claim 3 and further comprising Zr: 0.01 to 0.2%.

10. A high-corrosion-resistant martensitic stainless steel possessing excellent weldability, characterized by comprising steel constituents constituting a steel according to claim 4 and further comprising Zr: 0.01 to 0.2%.

11. A high-corrosion-resistant martensitic stainless steel possessing excellent weldability, characterized by comprising steel constituents constituting a steel according to claim 2 and further comprising at least one element selected from the group consisting of Ca: 0.001 to 0.02% and 0.003 to 0.4% of REM.

12. A high-corrosion-resistant martensitic stainless steel possessing excellent weldability, characterized by comprising steel constituents constituting a steel according to claim 3 and further comprising at least one element selected from the group consisting of Ca: 0.001 to 0.02% and 0.003 to 0.4% of REM.

13. A high-corrosion-resistant martensitic stainless steel possessing excellent weldability, characterized by comprising steel constituents constituting a steel according to claim 4 and further comprising at least one element selected from the group consisting of Ca: 0.001 to 0.02% and 0.003 to 0.4% of REM.

14. A process for producing a high-corrosion-resistant martensitic stainless steel possessing excellent weldability, characterized by comprising the steps of: subjecting a steel plate, produced by hot-rolling a stainless steel slab having a composition according to claim 2 to austenitization at a temperature of $Ac_3$ point to 1000° C. to harden the steel plate and heating to a dual phase region between $Ac_1$ point and $Ac_3$ point; subjecting the hardened steel plate to final tempering at a temperature of 550° C. to $Ac_1$ point; and cold-rolling the steel plate.

15. A process for producing a high-corrosion-resistant martensitic stainless steel possessing excellent weldability, characterized by comprising the steps of: subjecting a steel plate, produced by hot-rolling a stainless steel slab having a composition according to claim 3 to austenitization at a temperature of $Ac_3$ point to 1000° C. to harden the steel plate and heating to a dual phase region between $Ac_1$ point and $Ac_3$ point; subjecting the hardened steel plate to final tempering at a temperature of 550° C. to $Ac_1$ point; and cold-rolling the steel plate.

16. A process for producing a high-corrosion-resistant martensitic stainless steel possessing excellent weldability, characterized by comprising the steps of: subjecting a steel plate, produced by hot-rolling a stainless steel slab having a composition according to claim 4 to austenitization at a temperature of $Ac_3$ point to 1000° C. to harden the steel plate and heating to a dual phase region between $Ac_1$ point and $Ac_3$ point; subjecting the hardened steel plate to final tempering at a temperature of 550° C. to $Ac_1$ point; and cold-rolling the steel plate.

* * * * *